US007293682B2

(12) United States Patent
Naumanen et al.

(10) Patent No.: US 7,293,682 B2
(45) Date of Patent: Nov. 13, 2007

(54) ARRANGEMENT FOR BELT DRIVE DEVICE

(75) Inventors: Jari Naumanen, Tuusula (FI); Mauri Parri, Vantaa (FI)

(73) Assignee: Maillefer S.A., Ecublens (CH)

( * ) Notice: Subject to any disclaimer, the term of this patent is extended or adjusted under 35 U.S.C. 154(b) by 652 days.

(21) Appl. No.: 10/451,725

(22) PCT Filed: Jan. 18, 2002

(86) PCT No.: PCT/FI02/00040

§ 371 (c)(1),
(2), (4) Date: Jun. 25, 2003

(87) PCT Pub. No.: WO02/057169

PCT Pub. Date: Jul. 25, 2002

(65) Prior Publication Data

US 2004/0097320 A1 May 20, 2004

(30) Foreign Application Priority Data

Jan. 19, 2001 (FI) ..... 20010119

(51) Int. Cl.
*B65H 51/14* (2006.01)

(52) U.S. Cl. ..... 226/172; 226/188

(58) Field of Classification Search ..... 226/172, 226/188, 190, 194

See application file for complete search history.

(56) References Cited

U.S. PATENT DOCUMENTS 2,387,446 A * 10/1945 Herz ..... 198/626.6
2,642,280 A * 6/1953 Fisk ..... 226/172
2,797,798 A * 7/1957 Hallden ..... 226/172
2,884,120 A * 4/1959 Bruestle ..... 226/172
2,950,810 A * 8/1960 Reynolds ..... 226/172
4,000,636 A * 1/1977 Shubin et al. ..... 72/173

(Continued)

FOREIGN PATENT DOCUMENTS

EP 0 151 441 A2 8/1985

(Continued)

OTHER PUBLICATIONS

Bonfiglioli Technical Bulletin, pp. 1-18.

*Primary Examiner*—Saul Rodriguez
*Assistant Examiner*—Scott Haugland
(74) *Attorney, Agent, or Firm*—Oliff & Berridge, PLC

(57) ABSTRACT

The invention relates to an arrangement for a belt drive device, which comprises two continuous drive belts, which arc arranged to be operated by means of drive rollers (2), and which are arranged to travel around stretching rollers as continuous loops spaced apart, and which are arranged to be pressed by means of press rolls against the opposite surfaces of a cable or the like (3) to be drawn. In order to provide a simple structure, the drive rollers (2) are arranged to be rotated by a single power source by driving two planetary gears (8) connected in parallel and provided with angular front transmission. The rotary motion generated by the power source is arranged to be transmitted in the same direction to primary axles (9) of both planetary gears (8) provided with angular front transmission in order to rotate secondary axles (10) and the drive rollers (2) connected thereto in opposite directions.

11 Claims, 2 Drawing Sheets

U.S. PATENT DOCUMENTS

Figure 1:
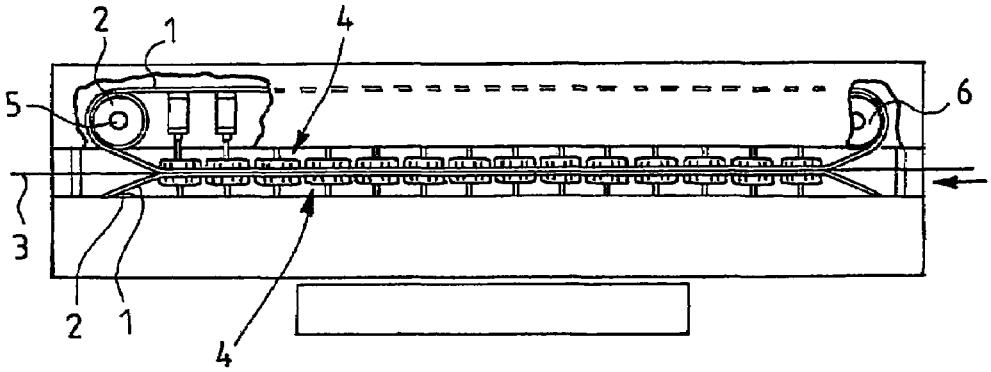

| | | | | |
|---|---|---|---|---|
| 4,655,107 | A | | 4/1987 | Juergenhake |
| 5,109,598 | A | * | 5/1992 | Koch ..... 29/825 |
| 5,497,928 | A | | 3/1996 | Burns et al. |
| 5,640,891 | A | | 6/1997 | Hoffa |

FOREIGN PATENT DOCUMENTS

| | | | |
|---|---|---|---|
| EP | 0 423 443 | A1 | 4/1991 |
| FI | 103613 | B | 7/1999 |
| WO | WO 99/48785 | | 9/1999 |

* cited by examiner

ARRANGEMENT FOR BELT DRIVE DEVICE

BACKGROUND OF THE INVENTION

The invention relates to an arrangement for a belt drive device, which comprises two continuous drive belts, which are arranged to be operated by means of drive rollers, and which are arranged to travel around stretching rollers as continuous loops spaced apart, and which are arranged to be pressed by means of press rolls against the opposite surfaces of a cable or the like to be drawn.

At present, belt drive devices mentioned above are commonly used in cable production lines, for instance. Flat transmission belts, i.e. belts whose both surfaces are smooth, are commonly used as cable driving belts, for example. Drive belts in which the surface that is being pressed against the cable is shaped in a suitable manner are also used in the field.

Drive belts are made to move by rotating the belt wheels of the drive device by means of a suitable power source, which is usually an electric motor. In several arrangements, the rotating force is transmitted from the power source by means of several separate gear systems connected in series, for example. The prior art also teaches arrangements where the power source consists of two separate electric motors and several belt drives. An example of the prior art arrangements is disclosed in Finnish Patent 103,613.

A drawback of the prior art arrangements is the complicated structure of the mechanism which transmits the force moving the drive belts from the power source to the belts. This has often resulted in a large and expensive transmission mechanism. The large size of the transmission mechanism is clearly disadvantageous and the high price thereof reduces its cost-effectiveness.

An object of the invention is to provide an arrangement eliminating the aforementioned drawback. This is achieved by the arrangement according to the invention, which is characterized in that the drive rollers are arranged to be rotated by a single power source by driving two planetary gears connected in parallel and provided with angular front transmission, and the rotary motion generated by the power source is arranged to be transmitted in the same direction to primary axles of both planetary gears with angular front transmission in order to rotate secondary axles and the drive rollers connected thereto in opposite directions.

An advantage of the invention over the prior art is that the transmission from the power source to the drive wheels can be implemented in a cost-effective and simple manner. Such a simple structure is also useful in view of maintenance and repair, since it is very easy to replace different components, for example.

Figure 2:
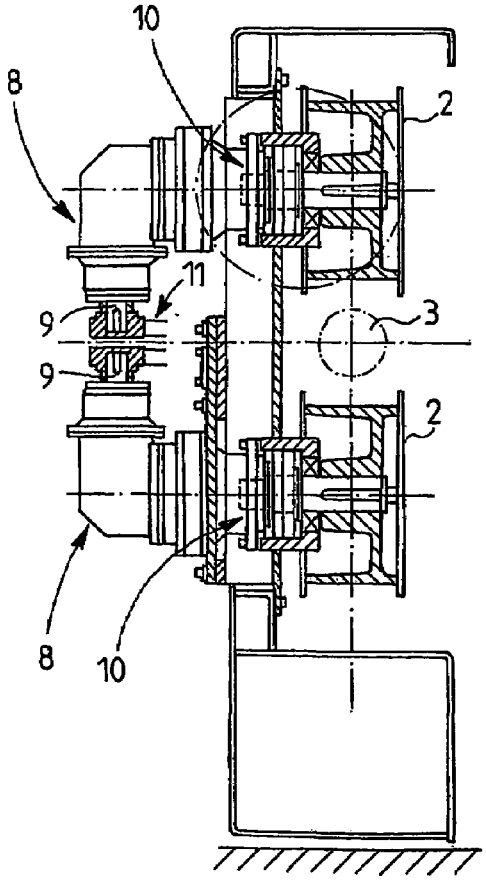
Figure 3:
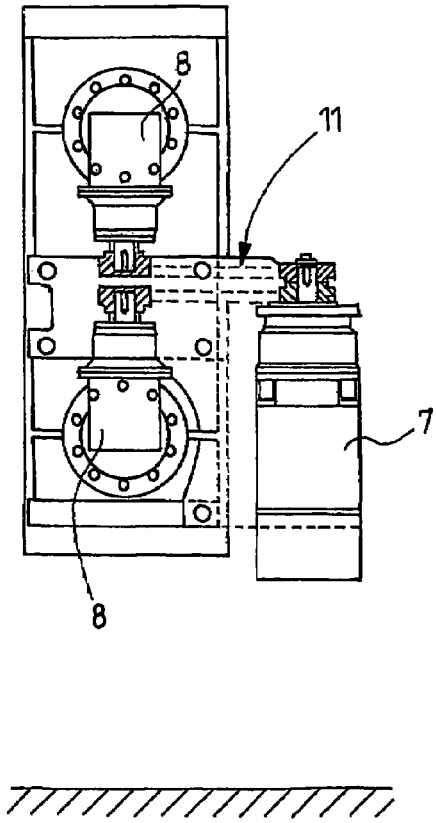
Figure 4:
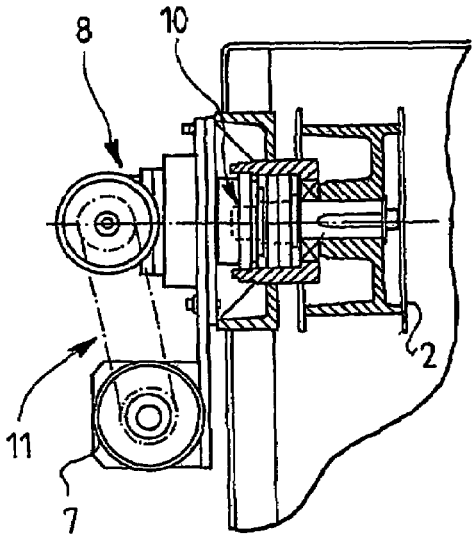
Figure 5:
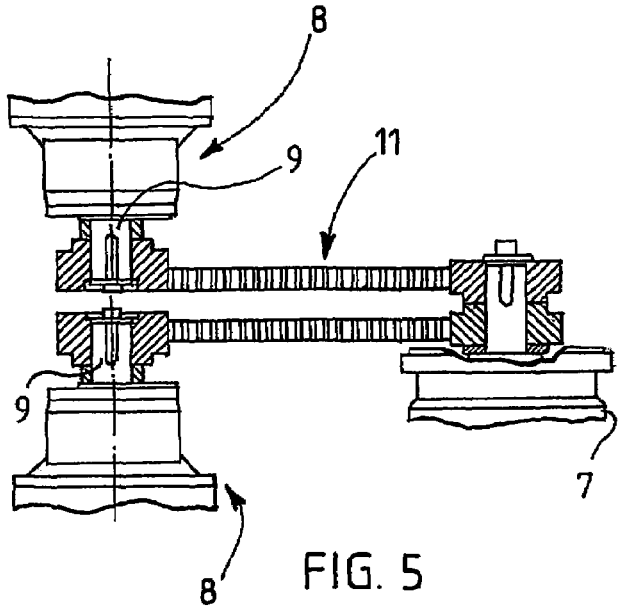
Figure 6:
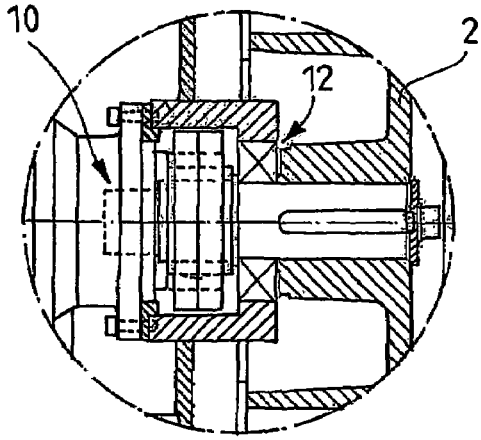

The invention will be described below in more detail by means of a preferred embodiment of the invention illustrated in the accompanying drawing, in which FIG. 1 shows a general side view of a belt drive device, FIG. 2 shows an arrangement according to the invention viewed from the direction of travel of a cable, FIG. 3 shows a side view of the arrangement according to the invention, FIG. 4 shows a top view of a detail of the arrangement according to FIGS. 2 and 3, FIG. 5 shows, on a larger scale, a drive belt arrangement used in the transmission of the embodiment according to FIGS. 2, 3 and 4, and FIG. 6 shows, on a larger scale, a detail indicated in FIG. 2 by a circle.

FIG. 1 shows schematically a belt drive device, which comprises two continuous drive belts 1, which are operated by means of drive rollers 2. The drive rollers are operated by means of a suitable power source, for example an electric motor. The drive belts 1 are arranged to travel at a distance from each other as continuous loops around stretching rollers 6, whereby a cable or the like 3 is arranged to travel between the drive belts in such a manner that the drive belts are pressed against the cable or the like, drawing it along as they travel. The expression 'cable or the like' refers herein to any product that acts similarly as a cable during the operation of the drive device. Examples include ropes, wires, etc, in addition to cables. The drive belts 1 are made to press against the cable or the like 3 by means of press rolls 4, which are pressed against the inner surfaces of the drive belts 1 at the point of the cable or the like 3. In the situation of FIG. 1, the direction of travel of the cable or the like is from the right to the left. The direction of travel is indicated in FIG. 1 by means of an arrow.

The above matters are known per se to those skilled in the art, wherefore they will not be discussed in further detail herein. In this connection, reference is made for example to Finnish Patent 103,613 cited above as representing the background art.

FIGS. 2 to 6 show schematically an arrangement according to the invention. In FIGS. 2 to 6, like reference numerals refer to like parts as in FIG. 1. For the sake of clarity, the drive belts are not shown in FIGS. 2 to 6.

According to a basic idea of the invention, the drive rollers 2 are arranged to be rotated by a single power source 7, which can be for example an electric motor, as stated above. The arrangement utilizes two planetary gears 8 connected in parallel and provided with angular front transmission. The planetary gears 8 with angular front transmission are arranged such that their primary axles 9 are parallel. This is clearly visible for example in FIGS. 2 and 5. The rotary motion generated by the power source 7 is arranged to be transmitted in the same direction to the primary axles 9 of both planetary gears 8 with angular front transmission in order to rotate secondary axles 10 and the drive rollers 2 connected thereto in opposite directions.

Any suitable device can be used as a planetary gear 8 with angular front transmission. An example of an applicable planetary gear provided with angular front transmission is the device 303R manufactured by Transmital Bonfiglioli.

The use of two planetary gears 8 provided with angular front transmission and arranged opposite one another enables the rotation of the drive rollers 2 in opposite directions in an advantageous manner, since the structure is very simple compared to the prior art arrangements. It should be noted that in the invention a single power source 7 makes the drive rollers rotate in opposite directions without a need for the previously used complicated separate gear mechanisms or other complex structures, such as the use of two power sources or the like. It can be estimated that for example in heavy-duty drives, the costs of the arrangement according to the invention are about 60% lower than those of the prior art arrangements.

Since the primary axles of the planetary gears 8 provided with angular front transmission are arranged to be parallel, the rotary motion generated by the power source 7 can be transmitted to the primary axles 9 of the planetary gears 8 with angular front transmission by means of a suitable transmission, such as a belt transmission 11, which advantagously makes the secondary axles rotate in opposite directions. In the example shown in the figures, the primary axles 9 are arranged to be parallel in such a manner that the symmetry axes thereof are on the same line. However, the primary axles can also be parallel for example such that their symmetry axes are spaced apart, if such an arrangement is considered necessary. The belt transmission 11 can be for example a transmission based on a toothed belt. In the example shown in the figures, the belt transmission consists of two parallel belts. The possibly rather great radial forces generated by the belt transmission 11 are distributed simultaneously to the primary axles 9 of both planetary gears 8 with angular front transmission. The belts are naturally designed suitably for each situation. The belt transmission can naturally be replaced with some other transmission mechanism known per se.

The radial loads of the secondary axles 10 of the planetary gears 8 provided with angular front transmission are in turn compensated by separate supporting bearings 12 arranged near the drive rollers 2 provided on the secondary axles 10. The supporting bearings 12 can be of any suitable type, such as cone bearings.

The embodiments described above are by no means intended to restrict the invention, but the invention can be freely modified within the scope of the claims. It is thus obvious that the arrangement according to the invention or the details thereof do not have to be identical to those shown in the figures, but various other solutions are also feasible.

The invention claimed is:

1. An arrangement for a belt drive device, which comprises two continuous drive belts, which are arranged to be operated by means of drive rollers, and which are arranged to travel around stretching rollers as continuous loops spaced apart, and which are arranged to be pressed by means of press rolls against the opposite surfaces of a cable to be drawn, wherein the drive rollers are arranged to be rotated by a single power source by driving two planetary gears connected in parallel and provided with angular front transmission, each planetary gear having an independently rotatable primary axle, and the rotary motion generated by the power source is arranged to be transmitted in the same direction to the primary axles of both planetary gears with angular front transmission in order to rotate secondary axles and the drive rollers connected thereto in opposite directions.

2. An arrangement according to claim 1, wherein the primary axles of the planetary gears provided with angular front transmission are arranged in parallel.

3. An arrangement according to claim 2, wherein the belt transmission consists of two belts, and the radial forces generated by the belt transmission are divided simultaneously to the primary axles of both planetary gears with angular front transmission.

4. An arrangement according to claim 3, wherein the radial loads of the secondary axles of the planetary gears provided with angular front transmission are arranged to be compensated by a separate supporting bearing arranged near the drive roller provided on the axle.

5. An arrangement according to claim 2, wherein the rotary motion generated by the power source is arranged to be transmitted to the primary axles of the planetary gears provided with angular front transmission by means of a belt transmission.

6. An arrangement according to claim 2, wherein the radial loads of the secondary axles of the planetary gears provided with angular front transmission are arranged to be compensated by a separate supporting bearing arranged near the drive roller provided on the axle.

7. An arrangement according to claim 1, wherein the rotary motion generated by the power source is arranged to be transmitted to the primary axles of the planetary gears provided with angular front transmission by means of a belt transmission.

8. An arrangement according to claim 7, wherein the belt transmission consists of two belts, and the radial forces generated by the belt transmission are divided simultaneously to the primary axles of both planetary gears with angular front transmission.

9. An arrangement according to claim 7, wherein the radial loads of the secondary axles of the planetary gears provided with angular front transmission are arranged to be compensated by a separate supporting bearing arranged near the drive roller provided on the axle.

10. An arrangement according to claim 1, wherein the radial loads of the secondary axles of the planetary gears provided with angular front transmission are arranged to be compensated by a separate supporting bearing arranged near the drive roller provided on the axle.

11. An arrangement for a belt drive device, which comprises two continuous drive belts, which are arranged to be operated by means of drive rollers, and which are arranged to travel around stretching rollers as continuous ioops spaced apart, and which are arranged to be pressed by means of press rolls against the opposite surfaces of a cable to be drawn, wherein the drive rollers are arranged to be rotated by a single power source by driving two gear systems each gear system having a driven, fixed and planetary gear, the gear systems connected in parallel and provided with angular front transmission, and the-rotary motion generated by the power source is arranged to be transmitted in the same direction to the primary axles of both planetary gears with angular front transmission in order to rotate secondary axles and the drive rollers connected thereto in opposite directions.

* * * * *